US009499941B2

(12) United States Patent
Shi et al.

(10) Patent No.: US 9,499,941 B2
(45) Date of Patent: Nov. 22, 2016

(54) HIGH STRENGTH MACROALGAE PULPS

(75) Inventors: Bo Shi, Neenah, WI (US); Michael William Veith, Fremont, WI (US); Candace Dyan Krautkramer, Neenah, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 653 days.

(21) Appl. No.: 13/481,125

(22) Filed: May 25, 2012

(65) Prior Publication Data

US 2013/0312924 A1 Nov. 28, 2013

(51) Int. Cl.

| | |
|---|---|
| ***D21H 11/12*** | (2006.01) |
| ***D21F 11/00*** | (2006.01) |
| ***D21H 13/10*** | (2006.01) |
| ***D21H 13/28*** | (2006.01) |
| ***D21H 27/00*** | (2006.01) |

(52) U.S. Cl.

CPC ..... *D21F 11/00* (2013.01); *D21H 11/12* (2013.01); *D21H 13/10* (2013.01); *D21H 13/28* (2013.01); *D21H 27/002* (2013.01); *D21H 27/005* (2013.01)

(58) Field of Classification Search

None

See application file for complete search history.

(56) References Cited

U.S. PATENT DOCUMENTS

| | | | | |
|---|---|---|---|---|
| 1,367,279 | A | 2/1921 | Ignacy | |
| 1,509,035 | A | 9/1924 | Curtis et al. | |
| 1,675,244 | A | 6/1928 | Frederick | |
| 2,965,436 | A | 12/1960 | De Domenico et al. | |
| 3,862,877 | A | 1/1975 | Camden | |
| 4,300,981 | A | 11/1981 | Carstens | |
| 5,114,534 | A * | 5/1992 | Rachor et al. | 162/9 |
| 5,200,194 | A | 4/1993 | Edgren et al. | |
| 5,472,569 | A | 12/1995 | Nicolucci et al. | |
| 5,500,086 | A | 3/1996 | Sakai et al. | |
| 5,522,967 | A * | 6/1996 | Shet | 162/9 |
| 5,567,275 | A | 10/1996 | Nicolucci et al. | |
| 5,743,999 | A * | 4/1998 | Kamps et al. | 162/113 |
| 6,379,594 | B1 | 4/2002 | Doepfner et al. | |
| 7,622,019 | B2 | 11/2009 | You et al. | |
| 2003/0186611 | A1 | 10/2003 | Zikeli et al. | |
| 2006/0137842 | A1* | 6/2006 | Garnier et al. | 162/158 |
| 2007/0207692 | A1 | 9/2007 | Ono et al. | |
| 2009/0197994 | A1 | 8/2009 | Han et al. | |
| 2010/0137776 | A1 | 6/2010 | Virkus et al. | |
| 2010/0152687 | A1 | 6/2010 | Carlozzi | |
| 2010/0206504 | A1* | 8/2010 | Akiyama et al. | 162/181.9 |
| 2010/0272940 | A1 | 10/2010 | Shi et al. | |
| 2010/0319865 | A1* | 12/2010 | Petersen et al. | 162/161 |
| 2011/0036525 | A1 | 2/2011 | Kim et al. | |
| 2011/0303375 | A1 | 12/2011 | Shannon et al. | |

FOREIGN PATENT DOCUMENTS

| | | | |
|---|---|---|---|
| CN | 101985779 | A | 3/2011 |
| CN | 102154738 | A | 8/2011 |
| DE | 102004061179 | A1 | 6/2006 |
| DE | 102008053858 | A1 | 5/2010 |
| EP | 0 565 920 | B1 | 10/1995 |
| EP | 1 682 721 | B1 | 5/2009 |
| GB | 508671 | A | 7/1939 |
| JP | 04-202893 | A | 7/1992 |
| JP | 05-331792 | A | 12/1993 |
| JP | 2000-236757 | A | 9/2000 |
| JP | 2011-012036 | A | 1/2011 |
| KR | 2006-0000695 | A | 1/2006 |
| KR | 10-0811193 | B2 | 3/2008 |
| KR | 10-0811194 | B1 | 3/2008 |
| KR | 10-0811196 | B1 | 3/2008 |
| KR | 10-0811200 | B1 | 3/2008 |
| KR | 10-0811183 | B3 | 3/2009 |
| KR | 10-2010-0011771 | A | 2/2010 |
| KR | 10-0965310 | B1 | 6/2010 |
| KR | 2010-0070240 | A | 6/2010 |
| KR | 2010-0084452 | A | 7/2010 |
| NL | 9001056 | A | 12/1991 |
| TW | 506831 | B | 10/2002 |
| WO | WO 92/02199 | A1 | 2/1992 |
| WO | WO 94/04745 | A1 | 3/1994 |
| WO | WO 96/24317 | A2 | 8/1996 |

OTHER PUBLICATIONS

Seo et al., Optical Properties of Red Algae Fibers, American Chemical Society, Sep. 28, 2010.*

Lee et al., Red algae and their use in papermaking, Bioresource Technology 101, Dec. 21, 2009.*

Co-pending U.S. Appl. No. 13/481,154, filed May 25, 2012, by Shannon et al. for "Tissue Comprising Macroalgae."

Earthrise® "Natural Spirulina Powder," Material Safety Data Sheet, Earthrise Nutritionals, Calipatria, CA, May 17, 2006, pp. 1-6.

Kim, Byong Hyun and Yung Bum Seo, "Application of Sea Algae Fiber for the Improvement of Compressibility and Physical Properties of Letter Press Printing Paper," Journal of Korea Technical Association of the Pulp and Paper Industry, vol. 4, No. 1, 2008, pp. 15-22.

Seo, Yung Bum et al., "Optical Properties of Red Algae Fibers," Industrial and Engineering Chemistry Research, American Chemical Society, vol. 49, No. 20, Sep. 28, 2010, pp. 9830-9833.

Seo, Yung-Bum et al., "Red Algae and Their Use in Papermaking," Bioresource Technology, vol. 101, 2010, pp. 2549-2553.

Ververis, C. et al., "Cellulose, Hemicelluloses, Lignin and Ash Content of Some Organic Materials and Their Suitability for Use as Paper Pulp Supplements," Bioresource Technology, vol. 98, 2007, pp. 296-301.

XX International Seaweed Symposium, International Seaweed Association, Ensenada Baja California Mexico, Feb. 22-26, 2010, pp. 1-2, 63, 108.

* cited by examiner

*Primary Examiner* — Michael H Wilson

*Assistant Examiner* — Eric Yaary

(74) *Attorney, Agent, or Firm* — Kimberly-Clark Worldwide, Inc.

(57) ABSTRACT

Novel pulps comprising conventional papermaking and macroalgae fibers are provided. By combining conventional papermaking fibers with never-dried macroalgae fibers, rather than dried macroalgae fibers, the disclosure provides pulp sheets having improved characteristics such as tensile and burst strength, with minimal deterioration in freeness.

15 Claims, 3 Drawing Sheets

HIGH STRENGTH MACROALGAE PULPS

BACKGROUND

In recent years, papermakers have begun exploring alternatives to wood pulp fibers as furnish for various grades of paper and tissue. One fiber that has been explored for use in paper is fiber derived from red algae and in particular red algae belonging to the division Rhodophyta. However, current processing is based on never-dried red algae fiber, containing about 85% moisture. The high water retention of the red algae fiber adds significant cost to shipping and storing the fiber. In addition, because of its chemical composition and fiber morphology, when red algae are pulped and subsequently dried the fibers undergo significant hornification such that physical properties, such as tensile strength, of products made from the fibers are greatly compromised. The hornification can become so significant that conventional repulping processes may not be able to disintegrate the dried red algae pulp into a useful form for papermaking.

Therefore there remains a need in the art for a method of processing macroalgae fibers to remove a portion of the water, without degradation of the fiber or impacting its usefulness as a replacement for wood pulp fibers in paper. There also remains a need in the art for a substantially dry pulp comprising macroalgae fibers that is easy to ship, store and process.

SUMMARY

The inventors have now discovered novel pulps comprising macroalgae fibers and methods of manufacturing the same. The pulps of the present disclosure are manufactured by blending never-dried macroalgae fibers with conventional papermaking fibers, forming a wet fiber web from the blended fibers and then drying the fiber web to form dry pulp sheets. The resulting pulp sheets surprisingly have improved strength and durability compared to both pulp sheets formed from dried macroalgae fibers and pulp sheets formed from conventional papermaking fibers alone. Further, pulps prepared according to the present disclosure are readily dispersible using traditional processing equipment, such as hydropulpers, and may be used as a substitute for conventional papermaking fibers in tissue webs without negatively effecting strength or stiffness and in certain instances may actually improve web strength without a corresponding increase in stiffness.

Accordingly, in one embodiment the present disclosure provides a pulp sheet comprising from about 1 to about 30 weight percent macroalgae pulp fibers, the pulp sheet having a moisture content less than about 15 percent, a basis weight of at least about 150 grams per square meter and an MD Tensile Index greater than about 10 Nm/g.

In yet another aspect the present disclosure provides a pulp sheet comprising at least about 70 percent by weight of a mixture of hardwood and softwood pulp fibers and from about 1 percent to about 30 percent by weight macroalgae fiber. This product preferably has a basis weight greater than about 150 grams per square meter and a moisture content of less than about 15 percent. Preferably the pulp sheet exhibits elevated tensile strength as compared with a like sheet made without macroalgae fiber, such as where the pulp sheet exhibits an MD Tensile Index at least about 20, 30 or 40 percent higher than a like sheet made without macroalgae. It is further preferred that the pulp sheet exhibits increased MD stretch as compared with a like sheet made without regenerated cellulose microfiber. In one embodiment, the pulp sheet exhibits an MD stretch of at least 5 percent.

In other embodiments the present disclosure provides a pulp sheet comprising from about 1 to about 30 weight percent Rhodophyta pulp fibers and hardwood or softwood pulp fibers, the pulp sheet having a moisture content less than about 15 percent, a basis weight greater than about 150 grams per square meter and an MD Tensile Index from about 10 to about 40 Nm/g.

In still other embodiments the present disclosure provides a method of making a pulp sheet comprising mixing never-dried macroalgae pulp fibers with conventional papermaking fibers to form a fiber slurry, transporting the fiber slurry to a web-forming apparatus and forming a wet fibrous web, and drying the wet fibrous web to a predetermined consistency thereby forming a dried fibrous web containing from about 1 to about 30 dry weight percent macroalgae pulp fibers.

DEFINITIONS

Figure 1:
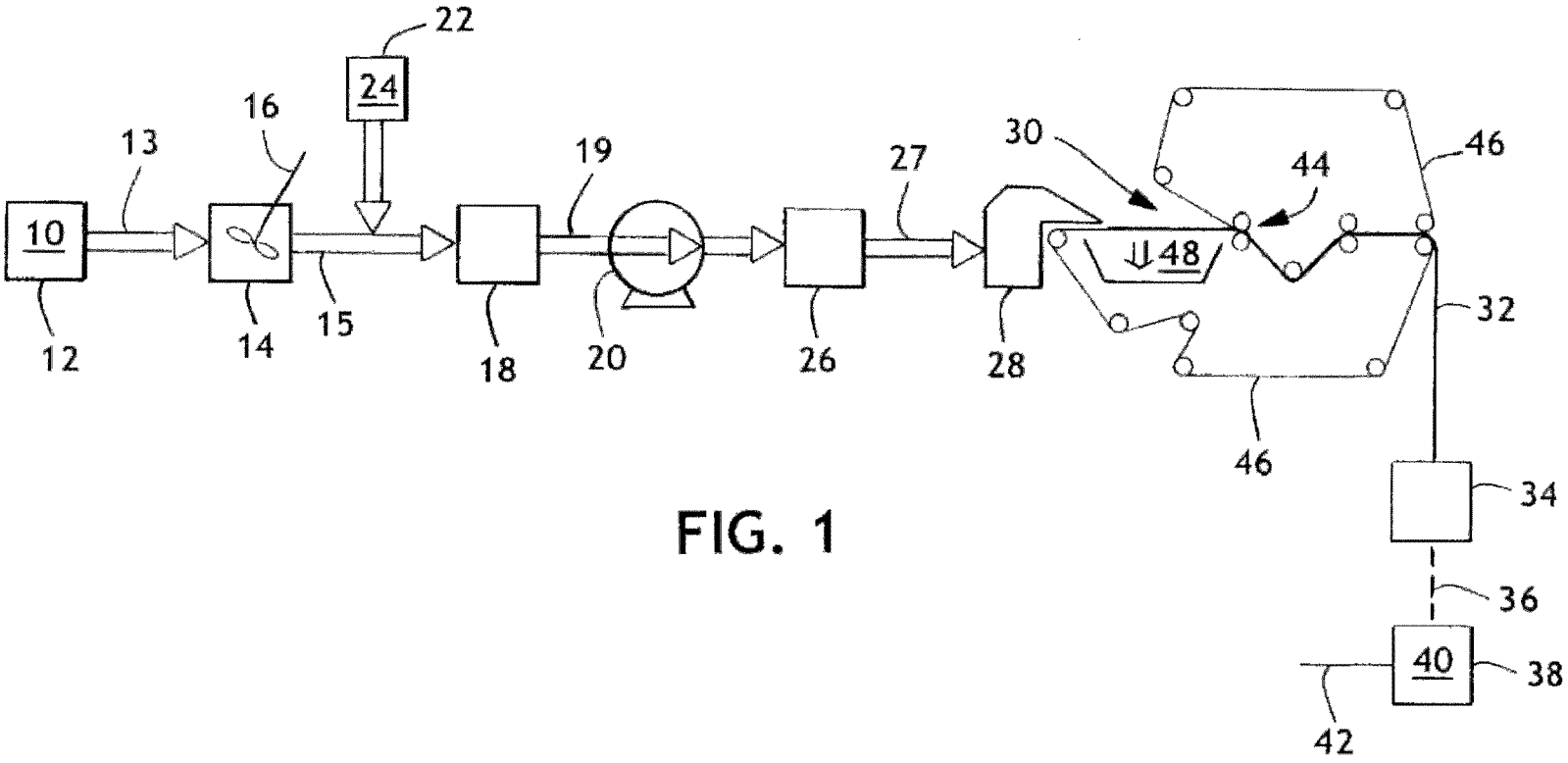
FIG. 1 depicts a schematic process flow diagram of a method according to the present disclosure for forming a pulp comprising never-dried red macroalgae pulp fibers.

As used herein the term "dry lap pulp" refers to a fibrous web having a basis weight of at least about 150 grams per square meter (gsm) and a moisture content of less than about 30 percent.

As used herein the term "macroalgae fibers" refers to any cellulosic fibrous material derived from red algae such as, for example, *Gelidium elegance, Gelidium corneum, Gelidium robustum, Gelidium chilense, Gracelaria verrucosa, Eucheuma Cottonii, Eucheuma Spinosum*, and *Beludulu*, or brown algae such as, for example, *Pterocladia capillacea, Pterocladia lucia, Laminaria japonica, Lessonia nigrescens*. Macroalgae fibers generally have an aspect ratio (measured as the average fiber length divided by the average fiber width) of at least about 80.

As used herein the term "red algae fiber" refers to any cellulosic fibrous material derived from Rhodophyta. Particularly preferred red algae fiber includes cellulosic fibrous material derived from *Gelidium amansii, Gelidium asperum, Gelidium chilense* and *Gelidium robustum*. Red algae fibers generally have an aspect ratio (measured as the average fiber length divided by the average fiber width) of at least about 80.

As used herein, the term "average fiber length" refers to the length-weighted average fiber length determined utilizing a Kajaani fiber analyzer model No. FS-100 (Kajaani Oy Electronics, Kajaani, Finland). According to the test procedure, a fiber sample is treated with a macerating liquid to ensure that no fiber bundles or shives are present. Each fiber sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length $x_i$=fiber length $n_i$=number of fibers having length $x_i$ n=total number of fibers measured.

As used herein the term "basis weight" generally refers to weight per unit area of a pulp sheet. Basis weight is measured herein using TAPPI test method T-220. A sheet of pulp, commonly 30 cm×30 cm or of another convenient dimension is weighed and then oven dried to determine the solids content. The area of the sheet is then determined and the ratio of the oven dried weight to the sheet area is reported as the bone dry basis weight in grams per square meter (gsm).

As used herein, the term "Tensile Index" is expressed in Nm/g and refers to the quotient of tensile strength, generally expressed in Newton-meters (N/m) divided by basis weight.

As used herein, the term "Burst Index" refers to the quotient of burst strength, generally expressed in kilopascals (kPa) divided by basis weight, generally expressed in grams per square meter (gsm).

As used herein, the term "Breaking Length" refers to the length of a sample strip that will break, under its own weight and may be calculated from MD tensile strength according to the formula:

$$\text{Breaking Length (km)} = \frac{MD\ \text{Tensile Strength (N)}}{\text{Sample Width (m)} \times \text{Basis Weight (gsm)} \times 9.807}$$

As used herein the term "Durability Index" generally refers to the ability of the web to resist crack propagation initiated by defects in the web and is calculated from MD tensile strength index (MD tensile strength divided by basis weight) and MD stretch according to the formula:

$$\text{Durability Index}=0.6\ (\text{MD Tensile Index (N/g)}^{0.74}+\text{MD Stretch (\%)}^{0.58})$$

Units of Durability Index are generally Jm/kg, however, for simplicity Durability Index is generally referred to herein without reference to units.

As used herein the term "web-forming apparatus" generally includes fourdrinier former, twin wire former, cylinder machine, press former, crescent former, and the like, known to those skilled in the art.

As used herein the term "Canadian standard freeness" (CSF) refers generally to the rate at which slurry of fibers drains and is measured as described in TAPPI standard test method T 227 om-09.

DETAILED DESCRIPTION

It has now been surprisingly discovered that pulp sheets comprising up to about 30 percent, by weight of the pulp sheet, macroalgae fibers may be produced without negatively affecting the dispersability or physical properties of the resulting pulp sheet. Moreover, the pulps may be used to form tissue products without negatively effecting physical properties such as tensile strength, porosity or stiffness. Currently, when macroalgae pulp fibers are dried to solids contents greater than about 50 percent, the breaking length of handsheets prepared from the pulps is greatly reduced and dispersability is impaired. However, it has now been discovered that macroalgae fibers may be blended with conventional papermaking fibers and then dried to a solids content greater than about 80 percent, such as from about 90 to 95 percent, without negatively effecting strength or dispers ability. These properties are retained even when the pulp sheet is subject to drying temperatures greater than about 170° C., such as from about 175° C. to about 180° C.

The production of the novel pulps comprising macroalgae fibers, and red algae fibers in particular, will now be described with reference to the figures. A variety of conventional pulping apparatuses and operations can be used with respect to the pulping phase, pulp processing, and drying of pulp. Nevertheless, particular conventional components are illustrated for purposes of providing the context in which the various embodiments of the invention can be used.

FIG. 1 depicts pulp processing preparation equipment used to prepare pulps according to one embodiment of the present disclosure. The pulp processing equipment comprises a pair of (high density) storage tank 12 where the conventional papermaking fiber and never-dried macroalgae fibers are held in the form of fiber slurries 10 comprised of the fiber and water. The consistency of the fiber slurry 10 when contained in the storage tank 12 may range from about 10 to about 12 percent fiber. In other embodiments, the consistency of the fiber slurry 10 in the storage tank 12 may range from about 8 to about 15 percent fiber.

The fiber slurries 10 are diluted and transferred from to separate storage tanks 12 through suitable conduits 13 to the blend chest 14 where the fiber slurries 10 are subjected to agitation using a mixing blade, rotor, recirculation pump, or other suitable device 16, thereby reducing variations in the fiber slurry 10. The consistency of the fiber slurry 10 in the blend chest 14 may be from about 0.5 to about 15 percent fiber. In other embodiments, the consistency of the fiber slurry 10 in the blend chest 14 may be from about 2 to about 10 percent fiber or from about 3 to about 5 percent fiber.

The slurries of never-dried macroalgae fibers and conventional papermaking fibers are added to the blend chest in amounts sufficient to yield the desired mixture of fiber types. Preferably the amount of never-dried macroalgae fibers added to the blend tank is sufficient to produce a pulp having a macroalgae fiber content from about 1 to about 30 percent by dry weight of the pulp, more preferably from about 3 to about 20 percent and more preferably from about 3 to about 15 percent. The mixed fiber slurries are desirably allowed to remain together in the machine chest 18 under agitation for a residence time sufficient to allow for mixing of the fibers. A residence time of at least about 10 minutes, for instance may be sufficient. In other embodiments, the residence time may range from about 10 seconds to about 30 minutes or from about 2 minutes to about 15 minutes.

The fiber slurry 10 is transferred from the blend chest 14 through suitable conduits 15 to a machine chest 18. The consistency of the fiber slurry 10 in the machine chest 18 may be from about 0.5 to about 15 percent fiber. In other embodiments, the consistency of the fiber slurry 10 in the machine chest 18 may be from about 2 to about 10 percent fiber or from about 3 to about 5 percent fiber.

The fiber slurry 10 is thereafter transferred from the machine chest 18 through suitable conduits 19 and a fan pump 20 to the screen device 26 where contaminates are removed based on size. The consistency of the fiber slurry 10 is typically decreased at some point during the transfer from the machine chest 18 to the fan pump 20. One example of the screen device 26 is a slotted screen or a pressure screen. The fiber slurry 10 may also be subjected to a series of centricleaners (not shown) to remove heavy particles from the fiber slurry 10 and an atenuator (not shown) to reduce the variability of the pressure going into the headbox 28.

The fiber slurry 10 is thereafter transferred through suitable conduits 27 to the headbox 28 where the fiber slurry 10 is injected or deposited into a fourdrinier section 30 thereby forming a wet fibrous web 32. The wet fibrous web 32 may be subjected to mechanical pressure to remove water. In the illustrated embodiment, the fourdrinier section 30 precedes a press section 44, although alternative dewatering devices such as a nip thickening device, or the like may be used. The fiber slurry 10 is deposited onto a foraminous fabric 46 such that the fourdrinier section filtrate 48 is removed from the wet fibrous web 32. The fourdrinier section filtrate 48 comprises a portion of the process water in addition to the unabsorbed chemical additive 24 in the water. The press section 44 or other dewatering device suitably increases the fiber consistency of the wet fibrous web 32 to about 30 percent or greater, and particularly about 40 percent or greater. The water removed as fourdrinier section filtrate 48 during the web forming step may be used as dilution water for dilution stages in the pulp processing, or discarded.

The wet fibrous web 32 may be transferred to a dryer section 34 where evaporative drying is carried out on the wet fibrous web 32 to a consistency of at least about 70 percent solids, and more preferably from about 80 to about 95 percent solids (a corresponding moisture content from about 5 to about 20 percent) and still more preferably from about 90 to about 99 percent solids, thereby forming a dried pulp sheet 36. In certain embodiments the web may be subjected to drying temperatures greater than about 170° C., such as from about 175° C. to about 180° C. The dried pulp sheet 36 may thereafter be formed into a roll or slit, cut into sheets, and bailed.

In certain embodiments the resulting pulp sheet has a moisture content of less than about 30 percent, more preferably less than 20 percent and still more preferably less than about 10 percent, such as from about 1 to about 10 percent. Pulp sheets may be produced at any given basis weight, however, it is generally preferred that the pulps have a basis weight of at least about 150 grams per square meter (gsm), such as from about 150 to about 600 gsm and more preferably from about 200 to about 500 gsm.

The ability of the pulp sheet to disperse and drain during sheet formation is quite important since, if sufficient drainage does not take place, the speed of the paper machine must be reduced or the wet-formed web will not hold together on the foraminous surface. A measure of this drainage parameter is freeness, and more particularly Canadian Standard Freeness (CSF), as described in TAPPI T-27. Accordingly, in certain embodiments pulps prepared according to the present disclosure have a Canadian Standard Freeness (CSF) greater than about 150 CSF, and more preferably greater than about 200 CSF, such as from about 200 to about 600 CSF.

Not only is it preferred that pulps comprising macroalgae have sufficient drainage and dispersability it is also preferred that in certain instances the addition of macroalgae improves the strength and durability characteristics compared to pulps prepared from conventional papermaking fibers alone or blends of conventional papermaking fibers and dried macroalgae fibers. As such, pulps prepared according to the present disclosure preferably have a machine direction (MD) Tensile Index greater than about 8 Nm/g, such as from about 8 to about 40 Nm/g and more preferably from about 10 to about 30 Nm/g.

In addition to having improved tensile strength, the pulp sheets also have improved dry burst strength. Accordingly, in one embodiment pulp sheets have a Peak Burst of at least about 30 kPa, such as from about 30 to about 100 kPa, and more preferably from about 40 to about 80 kPa.

In other embodiments the pulps have improved stretch, particularly in the machine direction (MD), such that the MD Stretch is greater than about 3%, such as from about 3% to about 6%, and more preferably from about 3% to about 4%.

As a result of having improved tensile and stretch properties, pulp sheets prepared according to the present invention also have improved durability, measured as Durability Index. Accordingly, in certain embodiments, pulp sheets have a Durability Index of about 5 or greater, such as from about 5 to about 10, and more preferably from about 6 to about 8.

Many conventional papermaking fibers may be used in the novel pulps of the present disclosure including wood and non-wood fibers, such as hardwood or softwoods, straw, flax, milkweed seed floss fibers, abaca, hemp, bamboo, kenaf, bagasse, cotton, reed, and the like. The papermaking fibers may be bleached or unbleached fibers, fibers of natural origin (including wood fiber and other cellulose fibers, cellulose derivatives, and chemically stiffened or cross-linked fibers), virgin and recovered or recycled fibers. Mixtures of any subset of the above mentioned or related fiber classes may also be used.

The conventional papermaking fibers can be prepared in a multiplicity of ways known to be advantageous in the art. The conventional papermaking fibers may be pulp fibers prepared in high-yield or low-yield forms and can be pulped in any known method, including mechanically pulped (e.g., groundwood), chemically pulped (including but not limited to the kraft and sulfite pulp processings), thermomechanically pulped, chemithermomechanically pulped, and the like. Particularly preferred methods of preparing fibers are kraft, sulfite, high-yield pulping methods and other known pulping methods. Fibers prepared from organosolv pulping methods can also be used, including the fibers and methods disclosed in U.S. Pat. Nos. 4,793,898, 4,594,130, and 3,585,104. Useful fibers can also be produced by anthraquinone pulping, exemplified by U.S. Pat. No. 5,595,628. When combining the conventional papermaking fibers with the macroalgae fibers, the conventional fibers, either dry lap or never-dried conventional papermaking fibers, may be used. For example, wet lap never-dried macroalgae fibers may be added to never-dried conventional fibers at the conventional fiber pulp mill prior to the conventional fibers being dried.

In addition to the foregoing pulping methods, the conventional papermaking fibers may also be subjected to useful preparation methods such as dispersion to impart curl and improved drying properties, as disclosed in U.S. Pat. Nos. 5,348,620, 5,501,768 and 5,656,132, the contents of which are hereby incorporated by reference in a manner consistent with the present disclosure.

The macroalgae fibers are preferably derived from algae from the Division Rhodophyta. More preferably the macroalgae fibers have been subjected to processing to remove hydrocolloids, and more preferably agar, from the cell wall. For example, macroalgae fibers may be processed by extracting heteropolysaccharides as a cell wall component with hot water, followed by freezing, melting and drying. More preferably the macroalgae fibers are prepared using pulping methods known in the art such as those disclosed in U.S. Pat. No. 7,622,019, the contents of which are incorporated herein in a manner consistent with the present disclosure. Regardless of the specific method of extraction, in certain embodiments it may be desirable that the macroalgae fibers have been processed such that the resulting fibers have an agar content of less than about 5 percent by weight of the fibers, more preferably less than about 3 percent by weight of the fibers and still more preferably less than about 2 percent by weight of the fibers.

In certain embodiments the pulped macroalgae fibers may be subjected to bleaching. For example, pulped macroalgae fibers may be subjected to a two stage bleaching treatment using a chlorine dioxide in the first stage and hydrogen peroxide in the second stage. In the first stage 5 percent active chlorine dioxide by dry weight of the material may be used to bleach the fiber at pH 3.5 and 80° C. for about 60 minutes. In the second stage, 5 percent active hydrogen peroxide by dry weight of the material may be used to bleach the fiber at pH 12 and 80° C. for about 60 minutes.

The macroalgae fibers preferably have an average fiber length greater than about 300 μm, such as from about 300 to about 1000 μm and more preferably from about 300 to about 700 μm. The macroalgae fibers preferably have a width greater than about 3 μm, such as from about 3 to about 10 μm, and more preferably from about 5 to about 7 μm. Accordingly, it is preferred that the macroalgae fibers have an aspect ratio greater than about 80, such as from about 100 to about 400 and more preferably from about 150 to about 350.

Further, regardless of the specific source of the fiber, the fiber length or the method of fiber processing, the macroalgae are preferably provided as never-dried macroalgae fibers. That is, after processing to remove a portion of the agar, the macroalgae fibers have not been dried, so as to maintain a moisture content greater than about 50 percent and more preferably greater than about 70 percent and still more preferably greater than about 80 percent. The never-dried macroalgae fibers are blended with conventional papermaking fibers to produce pulp sheet as described above. The conventional papermaking pulps may be provided as either dry or wet lap pulps. By combining never-dried macroalgae fibers and conventional papermaking fibers in this manner, the disclosure provides pulp sheets having surprising characteristics. For example, pulp sheets comprising red algae pulp fibers have improved tensile with minimal deterioration in freeness. Table 1 below shows the change (delta) in handsheet Tensile Index, and Freeness. The table compares a 60 gsm control handsheet formed from 100% EHWK with (1) a 60 gsm handsheet formed from a dry lap pulp comprising red algae (pulp sheet having 20% moisture and comprising 30% red algae pulp and 70% EHWK) and (2) a 60 gsm handsheet formed from a wet pulp comprising red algae (30% never-dried red algae pulp fibers and 70% EHWK).

TABLE 1

| | Delta Tensile Index | Delta Freeness |
|---|---|---|
| Dried Red Algae | +29.8% | −45.6% |
| Never-dried Red Algae | +164% | −66.4% |

TEST METHODS

Tensile

Tensile testing was conducted on a tensile testing machine maintaining a constant rate of elongation and the size of each test specimen measured 25 mm wide. More specifically, samples for dry tensile strength testing were prepared by cutting a 25 mm wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 75 mm. The crosshead speed was 300 mm/min, and the break sensitivity was set at 65 percent. The sample was placed in the jaws of the instrument, centered both vertically and horizontally. The test was then started and ended when the specimen broke.

For samples produced on a machine and having a machine (MD) and cross machine direction (CD), the peak load was recorded as either the "MD tensile strength" or the "CD tensile strength" of the specimen depending on direction of the sample being tested. Five representative specimens were tested for each product or sheet and the arithmetic average of all individual specimen tests was recorded as the appropriate MD or CD tensile strength of the product or sheet in units of grams of force per unit width. The geometric mean tensile (GMT) strength was calculated and is expressed as force (N) per sample width (m).

Burst Strength

Burst strength herein is a measure of the ability of a fibrous structure to absorb energy, when subjected to deformation normal to the plane of the fibrous structure. Burst strength was measured using the method described in ASTM D-3786-87 Diaphragm Bursting Strength Test Method using a Mullen Model CA (B. F. Perkins, Inc., Chicopee, Mass.), or equivalent. The testing apparatus comprises a pressure cylinder open on one end to the atmosphere and connected to a water reservoir and hydraulic gage. The other end of the pressure cylinder has a piston, which can be advanced by a motor drive to compress any water in the chamber. A valve is provided on the water reservoir as a convenience in filling the chamber and also to prevent reverse flow of the water back into the reservoir. A sample is mounted in a test ring that is clamped securely at the mouth of the pressure cylinder with the upper side of the underlay (which would in use contact the bottom of the carpet) presented to the pressure cylinder. Water pressure is then applied to the sample and the value of the pressure at which water is observed to break through the sample is noted.

Samples are conditioned under TAPPI conditions and cut into squares having an area of 7.3 $cm^2$. Once the apparatus is set-up, samples are tested by inserting the sample into the specimen clamp and clamping the test sample in place. The test sequence is then activated and upon rupture of the test specimen by the penetration assembly the measured resistance to penetration force is displayed and recorded. The specimen clamp is then released to remove the sample and ready the apparatus for the next test. A minimum of five specimens are tested per sample and the peak load average of five tests is reported as the Burst (kPa).

Air Permeability

The air permeability of handsheets was measured using procedure ASTM 3801. A Fraizer air permeability tester was used to carry out air permeability measurements. The units are cubic feet per minute per square foot (cfm/ft$^2$).

EXAMPLES

Commodity Eucalyptus dry lap pulp ("EHWK") samples were obtained from Fibria (San Paulo, Brazil). Commodity Southern softwood dry lap pulp ("SSWK") was obtained from Abitibi Bowater (Mobile, Ala.). Wet (never-dried) red algae pulp fiber having a consistency of about 15 percent was obtained from Pegasus International (Daejeon, Korea).

For all examples, handsheets were prepared by first measuring the appropriate amount of fiber (0.3% consistency) slurry required to obtain the desired basis weight. The slurry was then poured from the graduated cylinder into an 8.5-inch by 8.5-inch Valley handsheet mold (Valley Laboratory Equipment, Voith, Inc., Appleton, Wis.) that had been pre-filled to the appropriate level with water. After pouring the slurry into the mold, the mold was then completely filled with water, including water used to rinse the graduated cylinder. The slurry was then agitated gently with a standard perforated mixing plate that was inserted into the slurry and moved up and down seven times, then removed. The water was then drained from the mold through a wire assembly at the bottom of the mold that retained the fibers to form an embryonic web. The forming wire was a 90 mesh, stainless-steel wire cloth. The web was couched from the mold wire with two blotter papers placed on top of the web with the smooth side of the blotter contacting the web. The blotters were removed and the embryonic web was lifted with the lower blotter paper, to which it was attached. The lower blotter was separated from the other blotter, keeping the embryonic web attached to the lower blotter. The blotter was positioned with the embryonic web face up, and the blotter was placed on top of two other dry blotters. Two more dry blotters were also placed on top of the embryonic web. The stack of blotters with the embryonic web was placed in a Valley hydraulic press and pressed for one minute with 100 psi applied to the web. The pressed web was removed from the blotters and placed on a Valley steam dryer containing steam at 2.5 pounds per square inch (psig) and heated for 2 minutes, with the wire-side surface of the web next to the metal drying surface and a felt under tension on the opposite side of the web. Felt tension was provided by a 17.5 lbs of weight pulling downward on an end of the felt that extends beyond the edge of the curved metal dryer surface. The dried handsheet was trimmed to 7.5 inches square with a paper cutter and then weighed in a heated balance with the temperature maintained at 105° C. to obtain the oven dry weight of the web.

Scanning electron microscopy (SEM) images of select handsheets were obtained using the JSM-6490LV scanning electron microscope under the following operating conditions: accelerating voltage is 10 kilovolts; spot size is 40, working distance 20 millimeters, and magnification 300× to 500×. Handsheet cross-sections were prepared by cleaving the sheet with a fresh, razor blade at liquid nitrogen temperatures. The handsheet samples were mounted with double-stick tape and metalized with gold using a vacuum sputter for proper imaging in the SEM.

Example 1

Pulp sheets (as well as handsheets formed therefrom) comprising only wood pulp fibers or red algae fibers were formed for comparative purposes. Wood pulp sheets having a basis weight of 200 gsm were formed entirely from wood pulp fibers by first blending EHWK (50% by weight) and SSWK (50% by weight) together via disintegration and refining to Canadian standard freeness (CSF) of 500 mL in a Valley beater in general accordance with TAPPI T-200 sp-06. The refined wood pulp slurry was then dewatered and dried at 105° C. until the desired solid contents (see Table 2 below) was achieved. After drying to the targeted solid content the pulp sheets were dispersed in water by disintegration to achieve a pulp slurry having a consistency of 0.6%. The pulp slurry was then used to form handsheets having a basis weight of 60 gsm. The handsheets were subjected to physical testing as set forth in Table 2.

Similarly, a red algae pulp sheets having a basis weight of 200 gsm were formed entirely from never-dried red algae fibers. Red algae pulp sheets were formed by dewatering never-dried red algae pulp fibers and then drying at 105° C. until the desired solid contents (see Table 2 below) was achieved. After drying to the targeted solid content the pulp sheets were dispersed in water by disintegration to achieve a pulp slurry having a consistency of 0.6%. The pulp slurry was then used to form handsheets having a target basis weight of about 60 gsm. The handsheets were subjected to physical testing, the results of which are summarized in the table below.

TABLE 2

| | Handsheet formed from Wood Pulp Sheet | | | Handsheet formed from Red Algae Pulp Sheets | | |
|---|---|---|---|---|---|---|
| Pulp Sheet Solids Content (%) | Basis Weight (g/m$^2$) | Density (g/cm$^3$) | Tensile Index Nm/g | Basis Weight (g/m$^2$) | Density (g/cm$^3$) | Tensile Index Nm/g |
| 20 | 59.72 | 0.58 | 53.9 | 60.03 | 0.67 | 47.6 |
| 30 | 61.22 | 0.58 | 53.7 | 60.03 | 0.65 | 46.9 |
| 40 | 56.85 | 0.57 | 52.8 | 60.52 | 0.66 | 45.4 |
| 50 | 61.13 | 0.57 | 48.3 | 60.73 | 0.64 | 38.2 |
| 60 | 60.38 | 0.57 | 45.5 | 59.85 | 0.55 | 36.6 |
| 70 | 64.07 | 0.56 | 44.7 | 61.27 | 0.51 | 19.5 |
| 80 | 61.95 | 0.56 | 39.3 | 62.67 | 0.49 | 14.0 |
| 100 | 60.28 | 0.54 | 34.2 | 61.70 | 0.50 | 14.4 |

Figure 2:
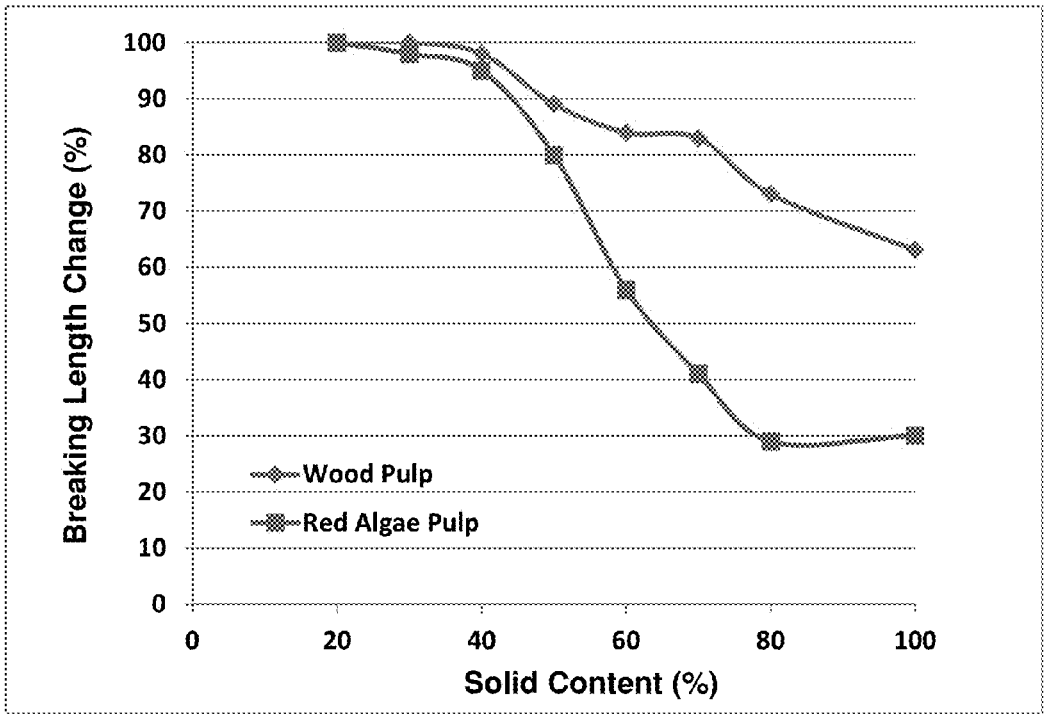
FIG. 2 plots breaking length versus solid contents for eucalyptus hardwood kraft ("EHWK") pulp sheets (diamonds) and red algae pulp sheets (squares) respectively.
Figure 3:
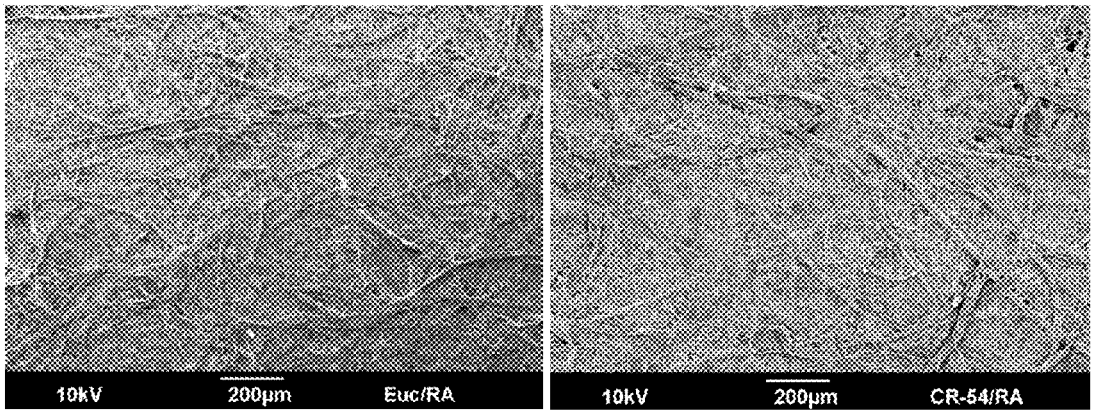
FIG. 3 is scanning electron micrographs of two pulps prepared according to the present disclosure, the pulp depicted in 3*a* was prepared from EHWK and never-dried red algae pulp fibers (70% EHWK/30% red algae) and the pulp depicted in 3*b* is was prepared from Southern softwood kraft ("SSWK") and never-dried red algae pulp fibers (70% SSWK/30% red algae).

The results in Table 2 indicate a decrease in tensile index as solid content increases for both wood and algae pulps. The decrease in tensile index is particularly rapid as the solid contents exceed 50 percent with the decrease in red algae pulps being particularly dramatic. The decrease in tensile index is illustrated in FIG. 2.

Example 2

Pulp sheets from a blend of EHWK dry lap pulp and never-dried red algae fibers were produced using a Fourdrinier machine comprising a wire forming section, a suction box, a pair of registered wet press rolls, and three cylindrical air dryer. Each fiber was weighed and the mixed fibers were dispersed in a pulper for 25 to 30 minutes to result in fiber slurry with a consistency of 3% and then returned to a stock tank for use in the formation of the pulp sheet. The entire stock preparation system was heated to 50° C.

The blended fiber was pumped from the stock tank to the headbox and deposited onto the forming section of the paper machine under pressure to increase drainage. The resulting fibrous web was pressed to further remove water using weight of the first press roll, which was adjusted to maximize caliper. The dewatered fibrous web was subjected to drying using a series of dryer cans, the initial dryer can pressures were 100 psig in the first, second, and third section, corresponding to about 177° C. Tables 3 and 4, below, summarize the paper machine setup and resulting pulp sheet properties.

TABLE 3

| | Pulp Sheet 1 | Pulp Sheet 2 | Pulp Sheet 3 |
|---|---|---|---|
| Machine Speed (fpm) | 62 | 62 | 60 |
| Moisture Content (%) | 7 | 7 | 7 |
| Wet Press #1 | Roll Weight | Roll Weight | Roll Weight |
| Wet Press #2 | Open | Open | Open |
| Dryer #1 Steam (psig) | 100 | 100 | 100 |
| Dryer #2 Steam (psig) | 100 | 100 | 100 |
| Dryer #3 Steam (psig) | 100 | 100 | 100 |
| Press #1 Draw | 2.5 | 3.1 | 3.0 |
| Press #2 Draw | Open | Open | Open |
| Dryer #1 Draw | −0.6 | −0.5 | −0.5 |
| Dryer #2 Draw | −0.2 | −0.1 | 0.0 |
| Dryer #3 Draw | −0.3 | −0.3 | −0.3 |
| Reel Draw | −0.2 | 0.6 | 1.8 |

TABLE 4

| Pulp Sheet Sample No. | EHWK (wt %) | Red Algae (wt %) | Basis Weight ($g/m^2$) | Moisture (wt %) | Caliper (mils) |
|---|---|---|---|---|---|
| Control | 100 | — | 275 | 6 | 21 |
| 1 | 90 | 10 | 243 | 6 | 22 |
| 2 | 80 | 20 | 202 | 7 | 18 |
| 3 | 70 | 30 | 190 | 10 | 17 |

Additional blended pulp sheets were prepared from dry lap SSWK and never-dried red algae, or a mixture of dry lap SSWK, dry lap EHWK and never-dried red algae, substantially as described above. Machine conditions were varied as described in Table 5, below. The resulting pulp sheet properties are summarized in Table 6.

TABLE 5

| | Pulp Sheet 4 | Pulp Sheet 5 | Pulp Sheet 6 | Pulp Sheet 7 |
|---|---|---|---|---|
| Machine Speed (fpm) | 57 | 60 | 60 | 57 |
| Moisture Content (%) | 7 | 7 | 7 | 7 |
| Wet Press #1 | Roll Weight | Roll Weight | Roll Weight | Roll Weight |
| Wet Press #2 | Open | Open | Open | Open |
| Dryer #1 Steam (psig) | 100 | 100 | 100 | 100 |
| Dryer #2 Steam (psig) | 100 | 100 | 100 | 100 |
| Dryer #3 Steam (psig) | 100 | 100 | 100 | 100 |
| Press #1 Draw | 1.8 | 2.0 | 2.0 | 1.8 |
| Press #2 Draw | Open | Open | Open | Open |
| Dryer #1 Draw | −0.6 | −0.5 | −0.4 | −0.5 |
| Dryer #2 Draw | 0 | −0.1 | −0.1 | −0.1 |
| Dryer #3 Draw | −0.2 | Open | Open | Open |
| Reel Draw | 0.1 | 2.0 | 2.4 | 0.3 |

TABLE 6

| Pulp Sheet Sample No. | EHWK (wt %) | Red Algae (wt %) | SSWK (wt %) | Basis Weight ($g/m^2$) | Moisture (wt %) | Caliper (mils) |
|---|---|---|---|---|---|---|
| 4 | — | 30 | 70 | 229 | 4.7 | 16 |
| 5 | — | 15 | 85 | 181 | 4 | 17 |
| 6 | 42.5 | 15 | 42.5 | 187 | 5.5 | 17 |
| 7 | 35 | 30 | 35 | 187 | 5.5 | 17 |

Pulp sheets were subject to physical testing, the results of which are summarized in Tables 7 and 8 below. The control pulp sheet comprised 100% EHWK.

TABLE 7

| Pulp Sheet Sample No. | Basis Weight ($g/m^2$) | MD Tensile (N/m) | MD Tensile Index (Nm/g) | MD Stretch (%) | Durability Index |
|---|---|---|---|---|---|
| Control | 275 | 1500 | 5.45 | 2 | 3.15 |
| 1 | 243 | 3400 | 13.99 | 2.8 | 5.79 |
| 2 | 202 | 4400 | 21.78 | 3.2 | 7.81 |
| 3 | 190 | 4900 | 25.79 | 3.2 | 8.75 |
| 4 | 229 | 3800 | 16.59 | 3.2 | 6.54 |
| 5 | 181 | 5100 | 28.18 | 2.8 | 9.20 |
| 6 | 187 | 4900 | 26.20 | 2.7 | 8.73 |
| 7 | 187 | 6800 | 36.36 | 3.3 | 11.10 |

TABLE 8

| Pulp Sheet Sample No. | Basis Weight ($g/m^2$) | Burst (kPa) | Burst Index |
|---|---|---|---|
| Control | 275 | 28.5 | 10.36 |
| 1 | 243 | 41.1 | 16.91 |
| 2 | 202 | 92.7 | 45.89 |
| 3 | 190 | 94.1 | 49.53 |
| 4 | 229 | 151 | 65.94 |
| 5 | 181 | 127 | 70.17 |
| 6 | 187 | 123 | 65.78 |
| 7 | 187 | 182 | 97.33 |

In each instance red algae increased MD Tensile Index, Durability Index and Burst Index of the pulp sheet relative to the control. Quite surprisingly when red algae was blended with both hardwood and softwood kraft fibers a synergistic improvement of MD Tensile Index, Durability Index and Burst Index was observed.

Handsheets

The pulp sheets prepared as described above were used to form handsheets. Handsheets were prepared using a modified TAPPI method as follows: 50 grams (oven-dry basis) of the dry lap pulp was soaked in 2 liters of deionized water for 5 minutes. The pulp slurry was then disintegrated for 5 minutes in a British disintegrator. After the 5 minutes of disintegration samples were inspected for nits by taking approximately 1-2 grams of the disintegrated slurry and placing it in a 500 ml beaker filled ¾ of the way with water. The slurry is mixed with the water in the beaker and inspected for nits by holding the suspension up to the light. In all cases no nits were observed indicating effective disintegration of the sample.

The slurry was diluted with water to a volume of 8 liters. During handsheet formation, the appropriate amount of fiber (0.625% consistency) slurry required to make a 60 gsm sheet was measured into a graduated cylinder. The slurry was then poured from the graduated cylinder into an 8.5-inch by 8.5-inch Valley handsheet mold (Valley Laboratory Equipment, Voith, Inc., Appleton, Wis.) that had been pre-filled to the appropriate level with water. After pouring the slurry into the mold, the mold was then completely filled with water, including water used to rinse the graduated cylinder. The slurry was then agitated gently with a standard perforated mixing plate that was inserted into the slurry and moved up and down seven times, then removed. The water was then drained from the mold through a wire assembly at the bottom of the mold that retains the fibers to form an embryonic web. The forming wire was a 90×90 mesh, stainless-steel wire cloth. The web was couched from the mold wire with two blotter papers placed on top of the web with the smooth side of the blotter contacting the web. The blotters were removed and the embryonic web was lifted with the lower blotter paper, to which it was attached. The lower blotter was separated from the other blotter, keeping the embryonic web attached to the lower blotter. The blotter was positioned with the embryonic web face up, and the blotter was placed on top of one other dry blotter. Two more dry blotters were also placed on top of the embryonic web. The stack of blotters with the embryonic web was placed in a Valley hydraulic press and was pressed for one minute with 100 psi applied to the web. The pressed web was removed from the blotters and placed on a Valley steam dryer containing steam at 2.5 psig pressure and heated for 2 minutes, with the wire-side surface of the web next to the metal drying surface and a felt under tension on the opposite side of the web. Felt tension was provided by a 17.5 lb. weight pulling downward on an end of the felt that extends beyond the edge of the curved metal dryer surface. The dried handsheet was trimmed to 7.5 inches square with a paper cutter and then weighed in a heated balance with the temperature maintained at 105° C. to obtain the oven dry weight of the web.

TABLE 9

| Handsheet Sample No. | Pulp Sheet Sample No. | Tensile Index (Nm/g) | Air Permeability (cfm/ft$^2$) | Delta Tensile Index (%) | CSF (ml) |
|---|---|---|---|---|---|
| Control | Control | 14.9 | — | — | 565 |
| 1 | 1 | 18.2 | 37.8 | 26% | 473 |
| 3 | 2 | 21.9 | 22.3 | 47% | 353 |
| 3 | 3 | 22.6 | 13.4 | 52% | 283 |

The data in Table 9 above illustrates that macroalgae fibers impart a tensile strength increase to the conventional papermaking fibers despite drying of the pulp sheet to a moisture content of less than about 10 percent.

Example 3

To further demonstrate fiber co-processing, simulated blended dry lap pulps were made from never-dried Eucalyptus hardwood kraft pulp (32% solids) (Fibria, San Paulo, Brazil) and a never-dried red algae pulp fibers (15% solids). Appropriate amounts of the never-dried pulps were weighed to give a total dry fiber weight of 50 grams. Two liters of distilled water was added to the wet lap pulps in a British Pulp disintegrator. The samples were then dispersed in the disintegrator for 5 minutes. The slurry was diluted with water to a volume of 8 liters. Handsheets were made with a basis weight of 200 gsm using the method described in Example 2 with the exception that the amount of slurry added to the handsheet mold was adjusted to give a target basis weight of 200 gsm. Simulated dry lap pulps were prepared for two different blends (by weight) of never-dried EHWK and never-dried red algae pulp fiber—90:10 and 60:40. After pressing the simulated pulp sheets were dried at 105° C. to a moisture content of about 10 percent. After drying the simulated pulp sheets were dispersed and used to form 60 gsm handsheets using the procedure described above. Physical properties of the 60 gsm handsheets are provided in Table 10 below.

TABLE 10

| Handsheet Sample No. | Red Algae (wt %) | Basis Weight (g/m$^2$) | Tensile Index (Nm/g) |
|---|---|---|---|
| 4 | 10 | 60 | 23.2 |
| 5 | 40 | 60 | 33.9 |

For comparative purposes, additional handsheets were prepared from Eucalyptus hardwood kraft wet lap pulp and never-dried red algae pulp fiber. Handsheets were prepared for three different blends (by weight) of EHWK and never-dried red algae pulp fiber—90:10 (Handsheet Sample No. 6), 80:20 (Handsheet Sample No. 7) and 70:30 (Handsheet Sample No. 8). Five handsheets at a basis weight of 60 gsm were prepared as described above for each blend and subjected to physical testing. The results of the physical testing are reported in Table 11 below.

TABLE 11

| Handsheet Sample No. | Red Algae (wt %) | Basis Weight (g/m$^2$) | Tensile Index (Nm/g) | Air Permeability (cfm/ft$^2$) | CSF (ml) |
|---|---|---|---|---|---|
| 6 | 10 | 60 | 34.0 | 20.1 | 315 |
| 7 | 20 | 60 | 42.7 | 7.9 | 235 |
| 8 | 30 | 60 | 46.0 | 4.9 | 175 |

We claim:

1. A pulp sheet comprising from about 1 to about 30 weight percent never-dried macroalgae pulp fibers, the pulp sheet having a moisture content less than about 15 percent, a basis weight of at least about 150 grams per square meter and an MD Tensile Index greater than about 10 Nm/g.

2. The pulp sheet of claim 1 further comprising conventional papermaking fibers selected from the group consisting of hardwoods, softwoods, straw, flax, milkweed seed floss fibers, abaca, hemp, bamboo, kenaf, bagasse, cotton, reed and combinations thereof.

3. The pulp sheet of claim 1 comprising at least about 30 weight percent hardwood fibers and at least about 30 weight percent softwood fibers.

4. The pulp sheet of claim 1 having a Burst Index greater than about 10.

5. The pulp sheet of claim 1 having a Durability Index greater than about 5.0.

6. The pulp sheet of claim 1 wherein the pulp sheet comprises from about 3 to about 15 weight percent macroalgae pulp fibers and at least about 30 percent hardwood pulp fibers.

7. The pulp sheet of claim 1 having a Canadian standard freeness of about 200 milliliters or greater.

8. The pulp sheet of claim 1 having an MD Tensile Index from about 10 to about 40 Nm/g.

9. The pulp sheet of claim 1 having a basis weight from about 180 to about 400 grams per square meter and a moisture content of less than about 10 percent.

10. A pulp sheet comprising from about 1 to about 30 weight percent never-dried Rhodophyta pulp fibers, less than about 30 weight percent softwood pulp fibers and greater than about 30 percent hardwood pulp fibers, the pulp sheet having a moisture content less than about 15 percent, a basis weight greater than about 150 grams per square meter and an MD Tensile Index from about 10 to about 40 Nm/g.

11. The pulp sheet of claim 10 wherein the Rhodophyta is selected from the group consisting of *Gelidium amansii, Gradilaria vetrucosa, Cottonii, Spinosum*, and combinations thereof.

12. The pulp sheet of claim 10 further comprising a non-wood fiber selected from the group consisting of straw, flax, milkweed seed floss fibers, abaca, hemp, bamboo, kenaf, bagasse, cotton, reed, and combinations thereof.

13. The pulp sheet of claim 10 having a Canadian standard freeness of about 200 milliliters or greater.

14. The pulp sheet of claim 10 having a Burst Index greater than about 10.

15. The pulp sheet of claim 10 having a Durability Index greater than about 5.0.

* * * * *